US006220231B1

(12) United States Patent
Kobayashi

(10) Patent No.: US 6,220,231 B1
(45) Date of Patent: Apr. 24, 2001

(54) DEVICE AND METHOD FOR IMPROVING ENGINE COMBUSTION BY USE OF MAGNETISM

(75) Inventor: Toshiki Kobayashi, Osaka (JP)

(73) Assignee: Big Bang Co., Ltd., Osaka (JP)

( * ) Notice: Subject to any disclaimer, the term of this patent is extended or adjusted under 35 U.S.C. 154(b) by 0 days.

(21) Appl. No.: 09/332,000

(22) PCT Filed: Dec. 26, 1997

(86) PCT No.: PCT/JP97/04905

§ 371 Date: Jul. 20, 1999

§ 102(e) Date: Jul. 20, 1999

(87) PCT Pub. No.: WO98/30796

PCT Pub. Date: Jul. 16, 1998

(30) Foreign Application Priority Data

Jan. 6, 1997 (JP) ..... 9-000283

(51) Int. Cl.[7] ..... F02M 27/04
(52) U.S. Cl. ..... 123/538
(58) Field of Search ..... 123/536, 537, 123/538; 210/222, 695

(56) References Cited

U.S. PATENT DOCUMENTS 4,372,852 2/1983 Kovacs .
5,070,852 12/1991 Po et al. .
5,271,369 * 12/1993 Melendrez ..... 123/538
5,520,158 * 5/1996 Williamson ..... 123/538
5,558,765 * 9/1996 Twardzik ..... 123/538
5,664,546 * 9/1997 De La Torre Barreiro ..... 123/538
5,816,226 * 10/1998 Jernigan et al. ..... 123/538
5,992,398 * 11/1999 Ho ..... 123/538
6,000,382 * 12/1999 Albisetti ..... 123/538

FOREIGN PATENT DOCUMENTS 48-21004 6/1973 (JP) .
55-153850 12/1980 (JP) .
58-25561 2/1983 (JP) .
60-78849 6/1985 (JP) .
6-264835 9/1994 (JP) .
8-14121 1/1996 (JP) .

* cited by examiner

*Primary Examiner*—Marguerite McMahon
(74) *Attorney, Agent, or Firm*—Jordan and Hamburg LLP

(57) ABSTRACT

A combustion improving device and a combustion improving method for an engine improves the combustion of an internal combustion engine such as a Diesel engine and can reduce noxious emissions, such as sooty smoke, or nitrogen oxides. To achieve this, magnetic poles of two magnets 2 are arranged in proximity to confront each other, so that fuel fed from a fuel tank to the engine is guided to pass through a gap 3 between the magnetic poles. At this passage, magnetic force (an attractive force or a repulsive force) per unit area to act between the confronting magnetic poles is set at 0.15 kgf/cm$^2$ or more, and a time period for the fuel to pass between the confronting magnetic poles is set at 1.7 seconds or more.

27 Claims, 10 Drawing Sheets

A: Fuel Injection Start
A-B: Ignition Delay Period
B: Ignition (Explosion) Start
C-D: Direct Combustion Period
D: Fuel Injection End
A-B-C-D-E: Embodiment
E: Combustion End
A-B'-C'-D'-E: Comparison

DEVICE AND METHOD FOR IMPROVING ENGINE COMBUSTION BY USE OF MAGNETISM

BACKGROUND OF THE INVENTION

The present invention relates to a combustion improving device and a combustion improving method using magnetism, which acts in a fuel feeding path for a Diesel engine and a gasoline engine with the aim of improving the combustions thereof.

JP-B-03030718 (Japanese Patent Examined Publication H3-30718) and JP-Y2-04021810 (Japanese Utility Model Examined Publication H4-21810) show devices in which a plurality of permanent magnets are fixed in a cylindrical casing in a combination to repulse each other and in which an inlet port and an outlet port are individually formed generally at centers of two bottom faces of the cylindrical casing so that a fuel may pass through the ports in the magnets or between the magnets.

In JP-U-3012313 (Japanese Utility Model Unexamined Registration 3012313 or Japanese Utility Model Application H6-16287), a fuel passage between magnetic poles of permanent magnets is filled with granular ceramics.

In the above prior art, however, the effect to improve the combustion has not been sufficient but has been frequently lost depending upon the type or displacement of the engine or the mode of using the combustion improving device. The following problems have arisen especially when a Diesel engine is used: (1) No effect is found; (2) Sooty smoke increases all the worse; (3) Running of the engine is unstable at idling mode; (4) The engine output decreases all the worse; (5) Running of the engine may become unstable and might stop; and (6) The engine will not start in some cases.

The aforementioned devices of the prior art have structures in which the air may reside in a combustion improving device to form relatively coarse air bubbles. When this happens, the air to fuel ratio in the engine combustion chamber deviates to cause an abnormal combustion.

It is therefore an object of the present invention to provide a combustion improving device and a combustion improving method, which can exhibit a combustion improving effect in a variety of engines without adverse effects such as forming the air bubbles.

SUMMARY OF THE INVENTION

According to the invention, there is provided a combustion improving device for an engine, comprising a fuel passage between magnetic poles arranged to confront each other, and disposed in a fuel feeding path from a fuel tank to the engine, characterized in that a magnetic force per unit area to act between said confronting magnetic poles is 0.15 kgf/cm$^2$ or more; in that a distance between the confronting magnetic poles is within such a range that the magnetic force between the confronting magnetic poles increases substantially in proportion to the decrease in said distance; and in that the time period for a fuel to pass between the confronting magnetic poles is 1.7 seconds or more.

Due to the above construction, the combustion of an internal combustion engine, such as a Diesel engine, can be improved to reduce noxious emissions such as sooty smoke or nitrogen oxides especially.

According to a further feature of the invention, there is provided a combustion improving device for an engine, comprising a fuel passage between magnetic poles arranged to confront each other, and disposed in a fuel feeding path from a fuel tank to the engine, characterized in that a quantity calculated by dividing a magnetic force per unit area between the confronting magnetic poles by a distance between the confronting magnetic poles is 0.20 kgf/cm$^3$ or more; in that the distance between the confronting magnetic poles is within such a range that the magnetic force between the confronting magnetic poles increases substantially in proportion to a decrease in said distance; and in that a time period for a fuel to pass between the confronting magnetic poles is 1.7 seconds or more.

According to another feature of the invention, there is provided a combustion improving device for an engine, comprising a fuel passage between magnetic poles arranged to confront each other, and disposed in a fuel feeding path from a fuel tank to the engine, characterized in that a product between a magnetic force per unit area between the confronting magnetic poles and a time period for a fuel to pass through the confronting magnetic poles is (0.15 kgf/cm$^2$)× (1.7 seconds) or more; and in that a distance between the confronting magnetic poles is within such a range that the magnetic force between the confronting magnetic poles increases substantially in proportion to a decrease in the distance.

According to another feature, there is provided a combustion improving device for an engine as set forth in above, characterized in that a fuel outlet port is formed in a wall generally parallel to the fuel passage and arranged at the uppermost portion.

Due to this construction, no air bubble resides in the fuel liquid in the combustion improving device so that no fine air bubbles will be collected to grow to coarse air bubbles thereby to prevent the combustion trouble which might otherwise be caused by feeding the coarse air bubbles entrained in the fuel to the engine combustion chamber.

According to still another feature, there is provided a combustion improving method for an engine, characterized in that a fuel is caused, when fed from a fuel tank to an engine, to pass through a gap between magnetic poles arranged in proximity to confront each other; and in that a magnetic force per unit area to act between the confronting magnetic poles is 0.15 kgf/cm$^3$ or more; and in that a time period for the fuel to pass between the confronting magnetic poles is 1.7 seconds or more.

Due to this construction, the combustion of the internal combustion engine can be improved to reduce the noxious emissions.

BRIEF DESCRIPTION OF DRAWINGS

FIG. 3(*b*) is a perspective view showing a baffle spacer in the device of the embodiment of FIG. 1.

FIG. 4 (*b*) is an external view of the combustion improving device of the embodiment of FIG. 1, as taken from an outlet side.

FIG. 8(*b*) is a filter face having collected sooty smoke in exhaust gases when the combustion improving device was not mounted.

FIG. 10(*b*) is a filter face having collected sooty smoke in exhaust gases when the combustion improving device was not mounted, under similar conditions to that of FIG. 10(*a*).

FIG. 11(*b*) is a filter face having collected sooty smoke in exhaust gases when the combustion improving device was not mounted, under similar conditions to that of FIG. 1.

FIG. 12(*b*) is a filter face having collected the sooty smoke in exhaust gases when the combustion improving device was not mounted, under similar conditions.

FIG. 13(*b*) is an indicator waveform (or combustion pressure waveform) diagram when the combustion improving device of FIG. 1 was not mounted.

DETAILED DESCRIPTION

A combustion improving device 1 of an embodiment of the invention will be described with reference to FIGS. 1 to 4.

Figure 1:
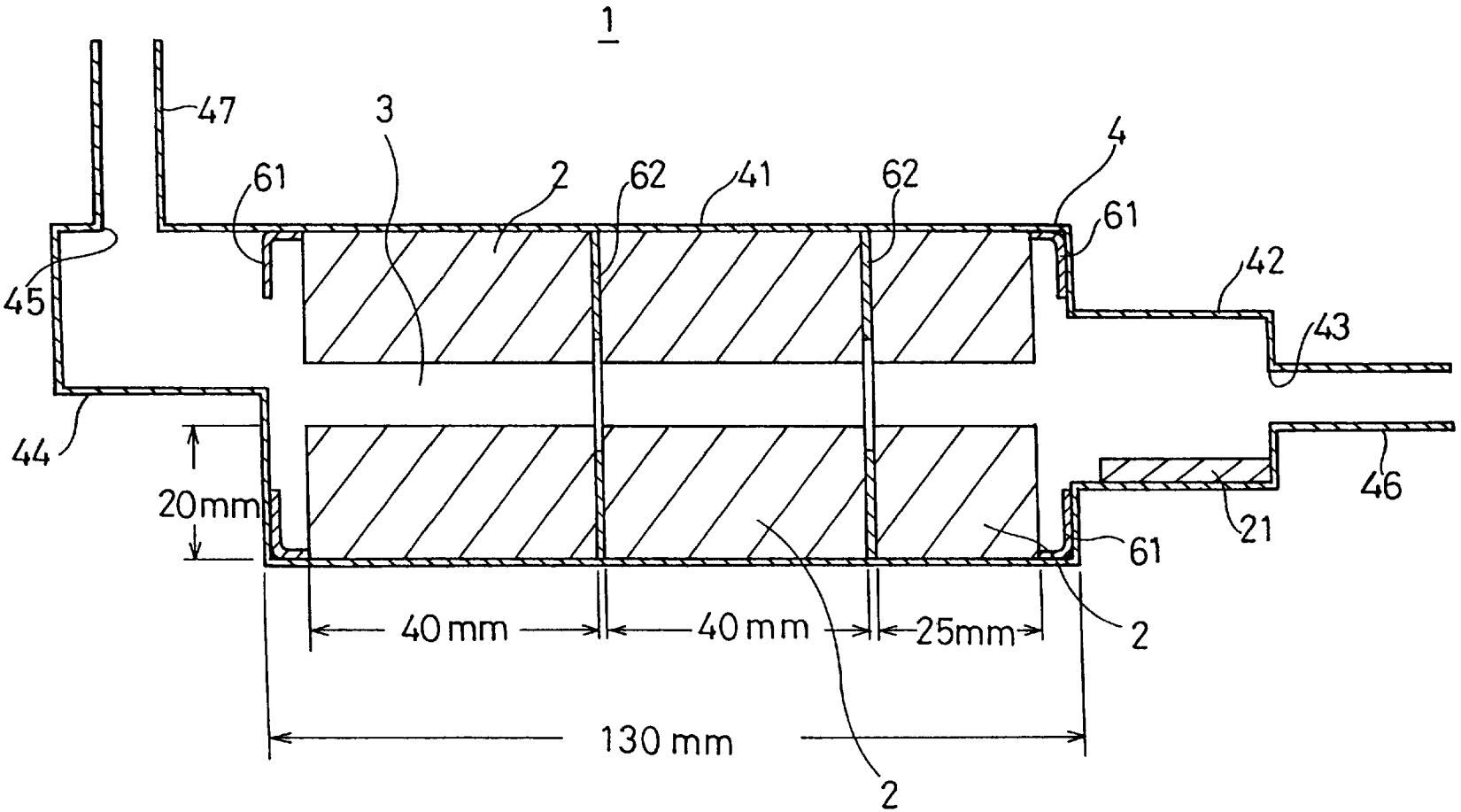
FIG. 1 is a vertical lengthwise sectional view of a combustion improving device of an embodiment.
Figure 2:
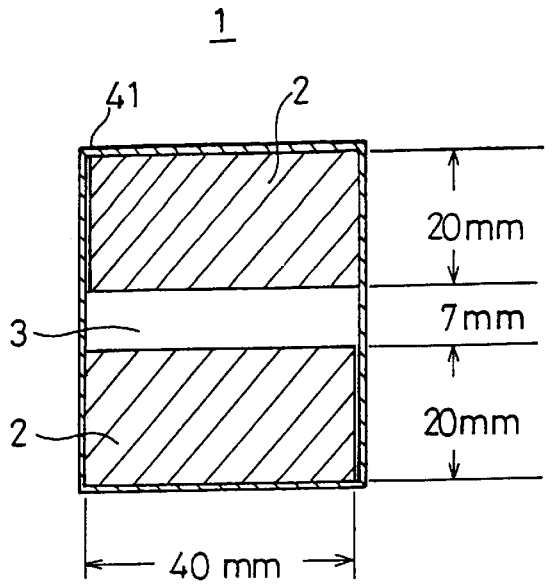
FIG. 2 is a vertical widthwise sectional view of the combustion improving device of the embodiment of FIG. 1.
Figure 3A:
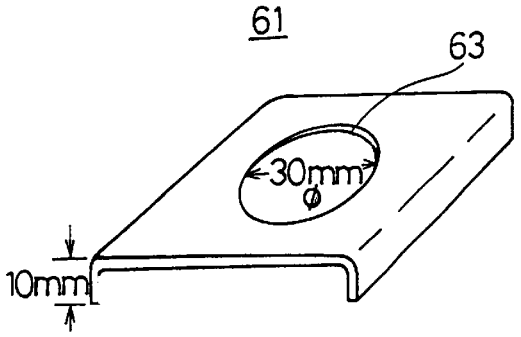
FIG. 3(*a*) is a perspective view showing a fitting for fixing a magnet in the device of the embodiment of FIG. 1.
Figure 3B:
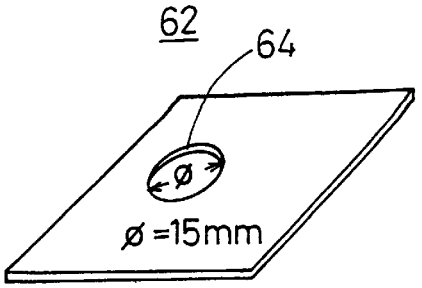

As shown in FIGS. 1 and 2 presenting vertical sections taken in the lengthwise and widthwise directions, permanent magnets 2 of rectangular shapes (having a width of 40 mm×a thickness of 20 mm×lengths of (40+40+25) mm) are arranged across a narrow gap (of 7 mm) forming a fuel passage 3. Upper and lower faces of each of the permanent magnets 2 are S pole and N pole. Magnet poles are arranged to repulse each other. A casing 4 for holding those permanent magnets 2 is formed of a magnetic material such as steel and is shaped such that an inlet barrel portion 42 and an outlet barrel portion 44 having a short barrel shape are joined with a long barrel portion 41 having a generally square sectional view. The long barrel portion 41 has an inner size of 40 mm×47 mm×130 mm.

Fittings 61 for fixing the magnets are provided at two ends of the long barrel portions 41, that is, at steped portions by which the long barrel portion 41 is joined with the inlet and outlet barrel portions 42, 44. Each of the fittings 61 for fixing the magnets 2 is shaped as a sheet of substantially square shape that is elongated and provided with a circular opening at the center of the sheet and has two opposed edges, that is upper and lower edges as seen in FIG. 1, of the sheet bent by 90 degrees to form legs.

On the other hand, two spacer sheets 62 which act as baffles in the fuel passage 3, are disposed between the permanent magnets 2 adjoining to each other in the lengthwise direction of the combustion improving device 1. As shown in a perspective view in FIG. 3(*b*), each of the spacer sheets 62 has one relatively small circular opening 64 at an eccentric portion. Sizes of the spacer sheet 62 is substantially equal to inner sizes of the widthwise-cut section of the long barrel portion 41. The openings 63 of the two baffle-acting spacer sheets 62 in the combustion improving device 1 are arranged such that one of the openings 63 is disposed at a righthand side while another one of the openings 63 is disposed at a lefthand side, in the fuel passage 3 having a narrow left-rightwise extending shape in a sectional view as shown in FIG. 2. Therefore, fuel flowing in through the inlet barrel portion 42 passes through the opening 63 on the lefthand side of FIG. 2 when passing through the first baffle-acting spacer sheet 62, the fuel then passes through the opening 63 on the righthand side of FIG. 2 when passing through the second baffle-acting spacer sheet 62. By this arrangement of the baffles, the fuel in the inter magnetic pole fuel passage 3 is acted on by the permanent magnets 2 more reliably.

When the permanent magnets 2 facing to each other are constructed to exert attractive forces upon each other, the aforementioned fittings 61 and spacer sheets 62 are provided with portions to engage with the faces, as confronting the fuel passage 3, of the permanent magnets 2.

Figure 4A:
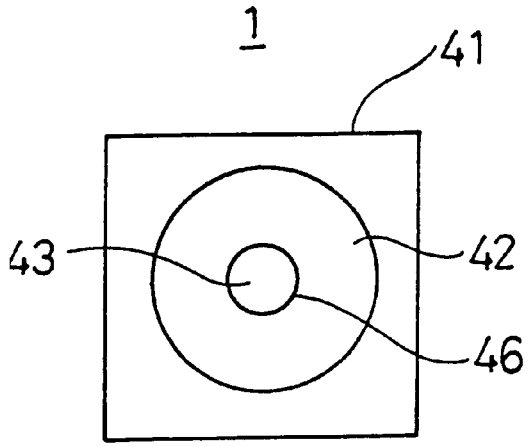
FIG. 4(*a*) is an external view of the combustion improving device of the embodiment of FIG. 1, as taken from an inlet side.
Figure 4B:
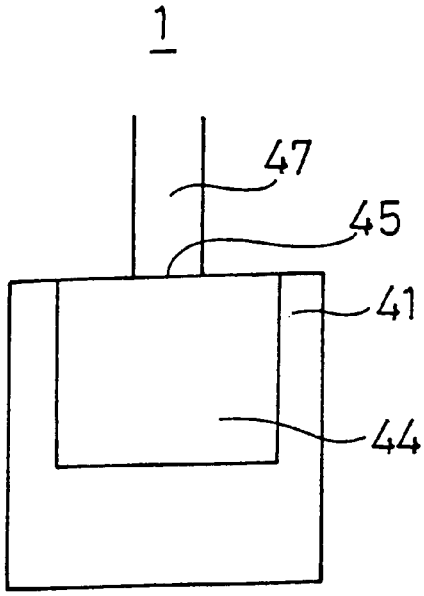

The inlet barrel portion 42 is joined substantially concentrically to the long barrel portion 41, as shown in the longitudinal sectional view of FIG. 1 and in the inlet-side external view of FIG. 4(*a*). The inlet barrel portion 42 is provided with an iron removing magnet 21. Generally at the center of the inlet barrel portion 42, there is formed an inlet port 43 which is connected to an inlet pipe 46 arranged generally horizontally.

The outlet barrel portion 44 is joined to the upper part of the long barrel portion 41, as shown in the longitudinal sectional view of FIG. 1 and in the outlet-side external view of FIG. 4(*b*). An upper wall of the outlet barrel portion 44 is continuous with an upper wall of the long barrel portion 41. In the upper wall of the outlet barrel portion 44, there is formed an outlet port 45 which is joined to an outlet pipe 47 arranged generally vertically.

Since the outlet port 45 is disposed at the uppermost portion of the combustion improving device 1, the air mixed in the fuel fed to the combustion improving device 1 is not left in the combustion improving device 1 so that no large air bubble is formed. The air may be mixed into the fuel (1) at the fuel suction port by vibration of a fuel tank when the fuel in a tank decreases, or (2) at the joint of the fuel feeding path when the feed from the fuel tank of the engine to the combustion chamber of the engine takes a negative pressure (a pressure lower than atmospheric pressure).

Figure 5:
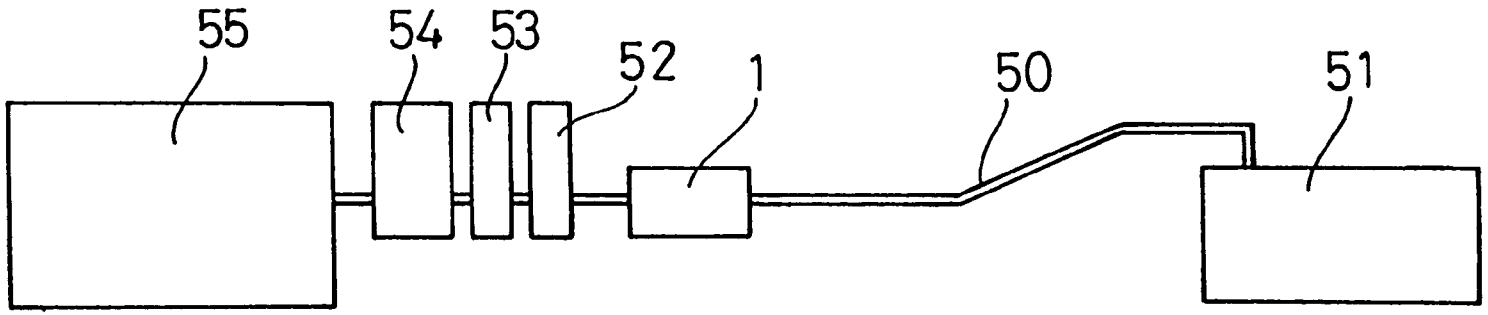
FIG. 5 is a schematic block diagram showing a mounting site of the combustion improving device.

As schematically shown in FIG. 5, the combustion improving device 1 thus far described is disposed in a fuel feed pipe 50 just upstream of a fuel pump 52. This fuel pump 52 draws the fuel from a fuel tank 51 and feeds it to a fuel injection device 54 attached to an engine 55. In the shown example, a fuel filter 53 is interposed between the fuel pump 52 and the fuel injection pump 54.

Here will be described a magnetic force (i.e., an attractive force or a repulsive force) to act between the opposed permanent magnets 2, with reference to FIGS. 6 and 7.

Figure 6:
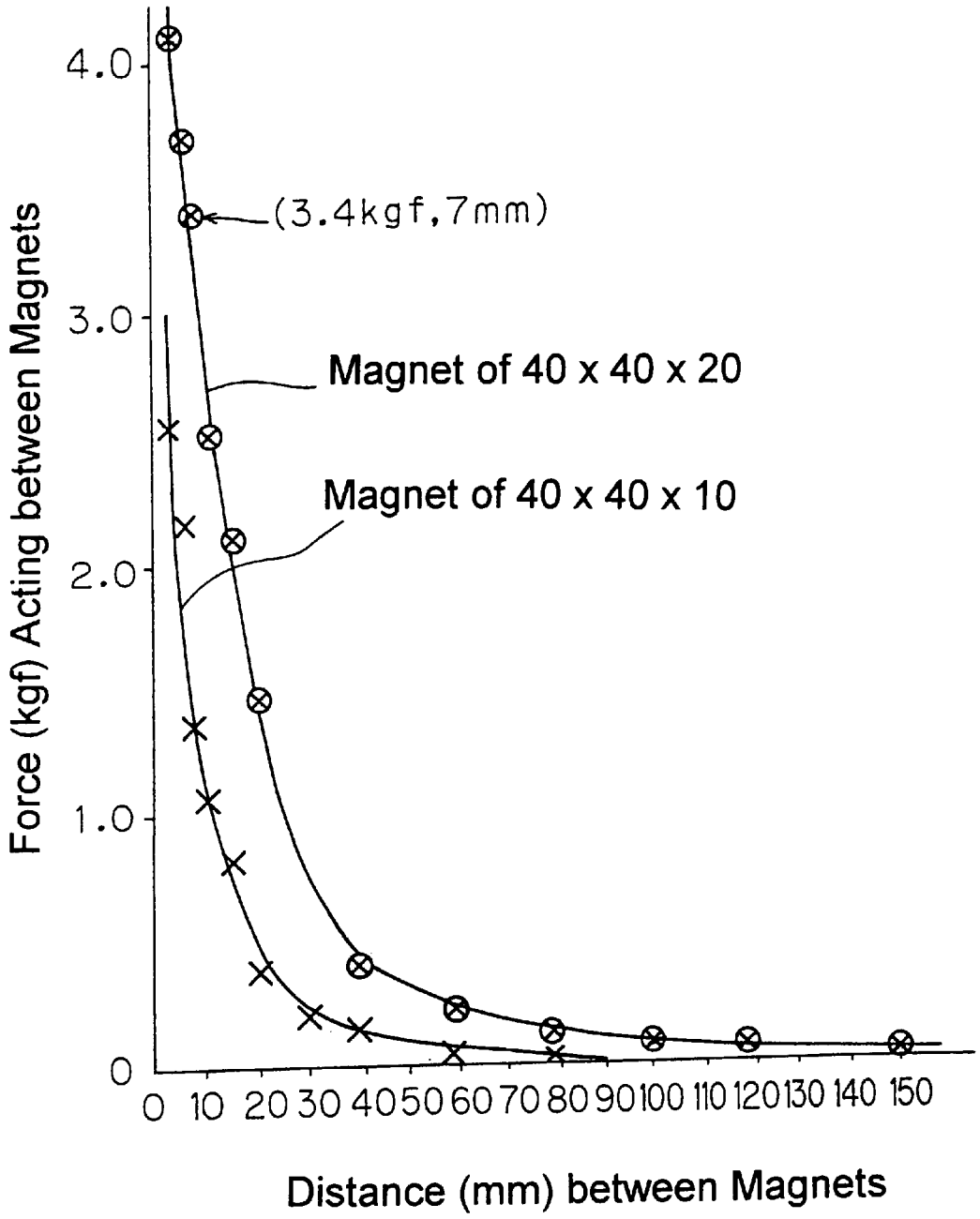
FIG. 6 is a graph plotting relations between a repulsive force to act between two magnets and a distance between the magnets, as to the same permanent magnets as those used in the combustion improving device 1 of the embodiment of FIG. 1 and permanent magnets having a half thickness.

FIG. 6 is a graphic diagram plotting relations between a repulsive force acting between two magnets and a distance between the magnets, which are the same as permanent magnets 2 (40 mm×40 mm×20 mm) of the combustion improving device 1 of the embodiment and permanent magnets (40 mm×40 mm×10 mm) having a half thickness. When one magnet was placed on a pan-at-top balance for weighing while the other magnet was arranged just over the former at a distance, an increase in the indicated value of the balance is taken as as the repulsive force and indicated by kgf pet square centimeters. At a large distance, the repulsive force is substantially inversely proportional to a square of the distance. In a range of a short distance, however, the increase in the repulsive force is substantially proportional to a decrease in the distance. This range is less than 10 mm in FIG. 6 and is shown in detail in FIG. 7. In case permanent magnets having the sizes of this embodiment are used, the distance between the magnets and the magnitude of the interacting magnetic force have a substantially accurate linear relation at an inter-magnet distance of 7 mm or less as shown in FIG. 7. In the linear relation or linear-functional relation, the force acting between a magnets increases in proportion to the decrease in the inter-magnet distance.

In case the distance between the magnetic poles of the confronting magnets is within the aforementioned range, the magnetic force acts homogeneously. In the device of the aforementioned embodiment, it is necessary for achieving reliable combustion improvement that the distance between the confronting magnetic poles forming the upper and lower walls of the inter magnetic pole fuel passage 3 be within such range.

Figure 7:
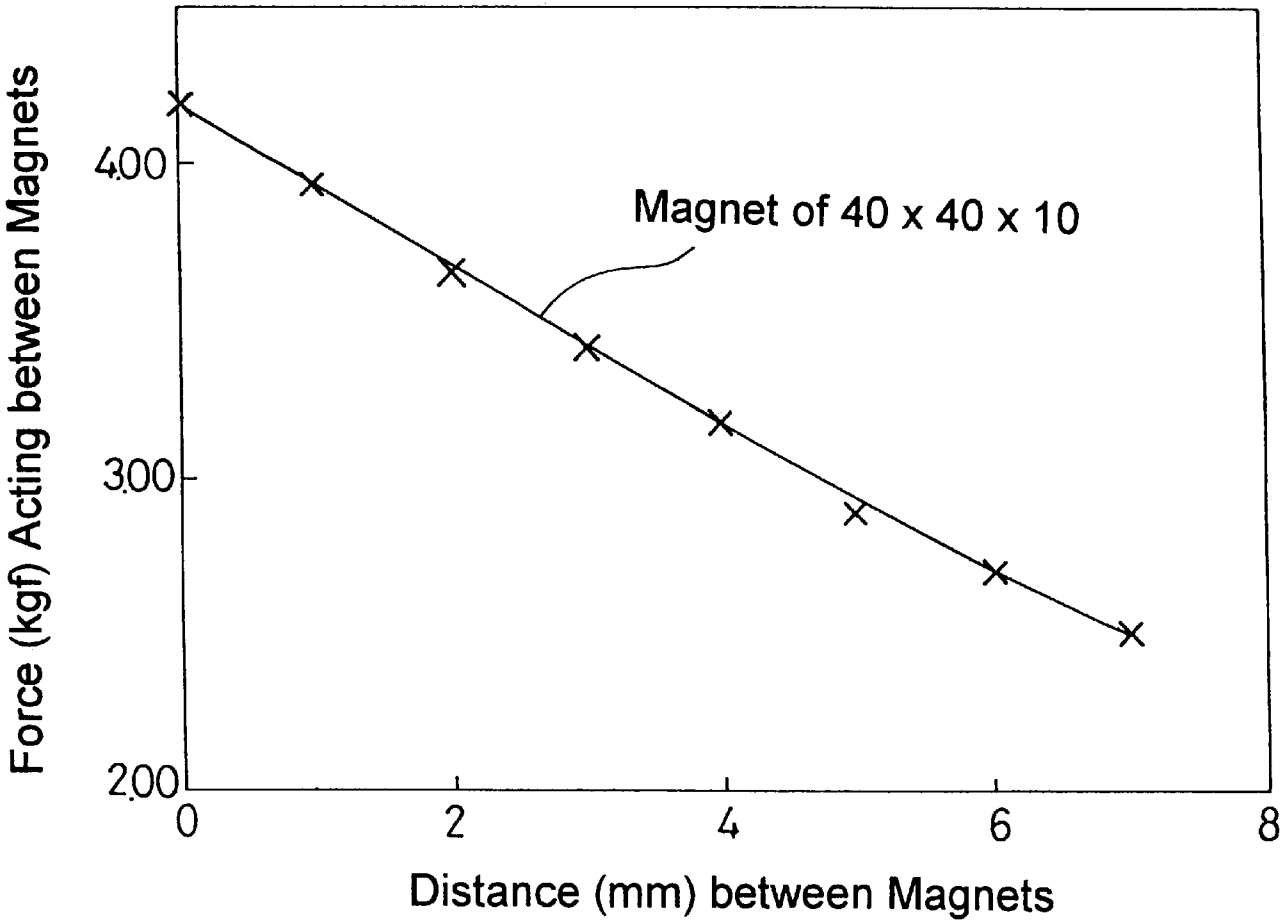
FIG. 7 is a graph plotting detail of a range less than 10 mm in FIG. 6.

In the case of the combustion improving device 1 of the aforementioned Exapmle, the distance between the magnets is 7 mm so that a magnetic force of 3.4 kgf per 40 mm×40 mm, i.e., a magnetic force of about 0.21 kgf per square centimeters acts homogeneously over all of the fuel passage between the magnets 2 as shown in the plots of FIGS. 6 and 7. The magnitude of the magnetic force (the attractive force or the repulsive force) thus homogeneously acting per unit area will be reffered to as the "magnetic pressure per unit area". The magnitude, as calculated by dividing that magnetic pressure per unit area by the distance between the inter magnetic poles, i.e., the thickness of the inter magnetic pole fuel passage 3 will be referred to as the "magnetic pressure per unit volume". In case, however, the inter magnetic pole fuel passage 3 is filled with substances such as ceramic balls which have no influence on magnetism, a correction is made on a basis of a net volume which is calculated by subtracting a volume of the filler from the volume of the inter magnetic pole fuel passage 3.

The magnitude of the magnetic pressure and the residence time of the fuel in the inter magnetic pole fuel passage 3 between the confronting magnetic poles, necessary for achieving the combustion improving effect, will be described by using the following test examples.

The test examples (of the embodiment and a comparison), in which the combustion improving device 1 thus far described is mounted in the fuel feeding path of a Diesel engine, will be described with reference to Tables 1 to 3 and FIGS. 8 to 13.

Table 1 is a transcription of "Record Table of Test Results of Diesel Car Exhaust Gases (in 6 Modes)", by Association (a foundation) of Japan Automobile Transportation Technique, on the combustion improving device 1 of this embodiment.

TABLE 1

| Record Table of Test Results of Diesel Car Exhaust Gases (in 6 Modes) | |
|---|---|
| Test Date: May 30, 1996 | Weather: Cloudy |
| Testing Agent: Japan Automobile Transportation Technique Association | |
| *Car Tested: | |
| Car Name: | Toyota Type N-LN61V |
| Total Travel Distance at Test: | 122136 Km |
| Test Car Weight: | 1660 Kg |
| Engine Type: 2L Max Output: | 85/4000 ps/rpm |
| Combustion Chamber Type: | Auxiliary |
| Supercharger: | Yes (1 set) |
| Fuel Used: | Light Oil (Specific Weight: 0.817) |
| Chassis No.: | LN61-0012525 |
| Total Car Weight: | 2135(2120) Kg |
| Equivalent Inertial Weight: | 1750 Kg |
| Cycles: 4 Cylinders: 4 | Total Displacement: 2446 cc |
| Fuel Injector: (Type: Distribution) | |
| Intake Air Cooler: No | |
| *Tester: | |
| Chassis Dynamometer: | Ono Sokki Co., Ltd. Made ZA-018 type |
| Exhaust Gas Anaylzer: | HORIBA, LTD. Made MEXA-8120D type |
| *Exhaust Gas Test | |
| Test Room Dry Bulb Temperature: | 27.0° C.–27.4° C. |
| Test Room Wet Bulb Temperature: | 17.6° C.–17.6° C. |
| Test Room Relative Humidity: | 38% |
| Test Room Atmosphere: | 754.4 mmHg |
| Test Starting Time: | 11:55 |
| Test Ending Time: | 12:20 |
| Cooling Water Temperature: | 80° C.–86° C. |
| Lubricant Temperature: | 101° C.–118° C. |

TABLE 1-continued

| Drive Mode | Speed of Prime Mover rpm | Load Factor of Prime Mover % | A Air Flow Rate g/h | F Fuel Flow Rate g/h | Exhaust Concentrations Measured CO ppm | HC ppmC | Nox ppm | K Correction Coefficient | WF Weight Coefficient | Exhaust Concentrations CO ppm | HC ppmC | Nox ppm |
|---|---|---|---|---|---|---|---|---|---|---|---|---|
| 1 | Idling | — | 45940 | 495 | 61 | 18.0 | 107 | 0.980 | 0.355 | 21.3 | 6.4 | 35.9 |
| 2 | 40% | 100 | 120342 | 7226 | 660 | 151 | 262 | 0.886 | 0.071 | 41.6 | 10.8 | 15.9 |
| 3 | 40% | 25 | 113351 | 2275 | 140 | 38.2 | 143 | 0.962 | 0.059 | 8.0 | 2.3 | 7.9 |
| 4 | 60% | 100 | 217714 | 13927 | 970 | 87 | 383 | 0.878 | 0.107 | 91.2 | 9.3 | 34.7 |
| 5 | 60% | 25 | 182260 | 4397 | 327 | 138 | 202 | 0.954 | 0.122 | 38.1 | 16.9 | 22.7 |
| 6 | 80% | 75 | 290618 | 13750 | 235 | 61 | 370 | 0.910 | 0.286 | 61.2 | 17.5 | 92.9 |
| | | | | | | | | Average Exhaust Concentrations | | 262 | 64 | 210 |

KH (Nox Moisture Correctiion Coefficient) 0.964
ⓒRemarks
Normal No-Load engine Speed: 700 rpm Injection Timing: 0° BTDC Table 2 compares the average exhaust concentrations in Table 1, with the reported exhaust concentrations for the car, used for the tests, at the time the car was new.

TABLE 2

| | Kinds & Concentrations of Exhaust Gases | | |
|---|---|---|---|
| | CO (ppm) | HC (ppm) | NOx (ppm) |
| Concentrations when Test Car was new | 380 | 135 | 260 |
| Concentrations when the Device is mounted | 262 | 64 | 210 |
| Reduction Percentages | −31% | −53% | −19% |

("Concentrations when Test Car was new" is the value Reported to Transportation Ministry)

As seen from Table 2, the exhaust concentrations of carbon monoxide, hydrocarbons and nitrogen oxides were far lower than the reported numerical values when the device 1 of this embodiment was mounted.

Figure 8A:
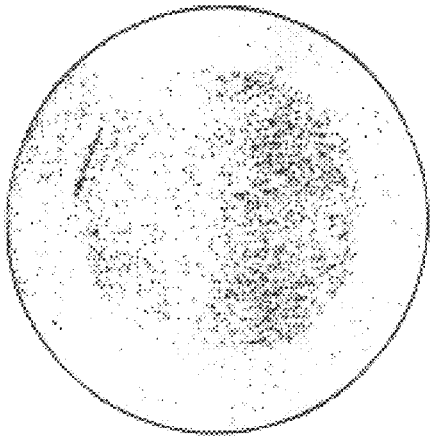
FIG. 8(*a*) is a filter face having collected sooty smoke in exhaust gases when FIG. 1 combustion improving device of the was mounted while a magnetic force per area was set at 0.213 kgf/cm$^{2}$.
Figure 8B:
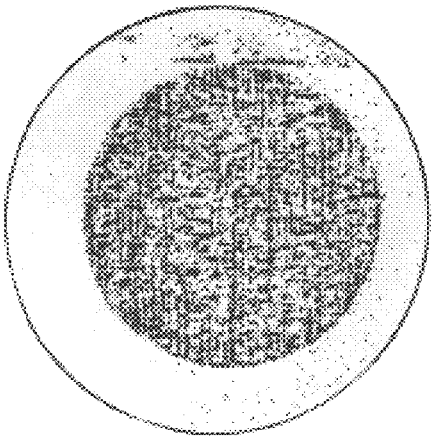

FIGS. 8(*a*) and 8(*b*) respectively show the amounts of sooty smoke in the exhaust gases qualitatively for the example where the combustion improving device 1 (having a magnetic pressure per unit area of 0.213 kgf/cm$^2$ and a magnetic pressure per unit volume of 0.304 kgf/cm$^3$) was used in the same car as that of the aforementioned test examples, and for a comparison where the device was not used. FIGS. 8(*a*) and 8(*b*) are obtained by directly copying, by use of a copying machine, faces of paper filters having collected the sooty smoke particles of the exhaust gases. In the tests, the fuel flow rate was set such that the residence time of the fuel in the inter magnetic pole fuel passage 3 between the magnetic poles was about 2 seconds. In other words, the engine speed and the engine load factor were set to achieve that residence time.

In the case (FIG. 8 (*a*)) using the device 1 of the embodiment, the sooty smoke was very little. In the case absent the device 1 (FIG. 8(*b*)), on the contrary, much sooty smoke was collected.

Figure 9:
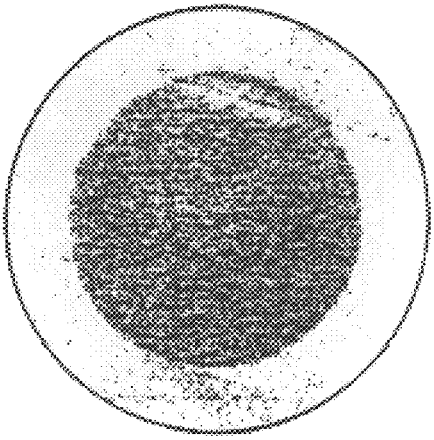
FIG. 9 is a filter face having collected sooty smoke in exhaust gases when a magnetic force per area was set at 0.175 kgf/cm$^{2}$.

In FIG. 9, an example similar to that of FIG. 8 is presented in case the combustion improving device 1 (having a magnetic pressure per unit area of 0.175 kgf/cm$^2$ and a magnetic pressure per unit volume of 0.250 kgf/cm$^3$) using permanent magnets of a somewhat lower magnetic force than that of the above Example was mounted on the same car as that of the aforementioned test examples. In this case, the sooty smoke is prominently less than that of the case of FIG. 8(*b*) using no combustion improving device but is considerably more than that of the case of the embodiment shown in FIG. 8(*a*).

From these results, it has been found that a magnetic force of a certain magnitude is necessary for achieving the combustion improving effect. The necessary magnetic force is a magnetic pressure per unit area of 0.15 kgf/cm$^2$ or more, preferably 0.175 kgf/cm$^2$ or more, or more preferably 0.20 kgf/cm$^2$ or more. On the other hand, the magnetic pressure per unit volume is 0.20 kgf/cm$^3$ or more, preferably 0.25 kgf/cm$^3$ or more, or more preferably 0.29 kgf/cm$^3$ or more.

Figure 10A:
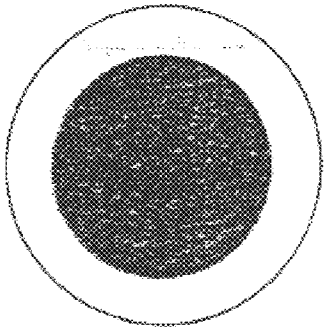
FIG. 10 (*a*) is a filter face having collected the sooty smoke in exhaust gases when FIG. 1 combustion improving device of the was mounted while a time period for a fuel to reside in the device was set at 1 second.
Figure 10B:
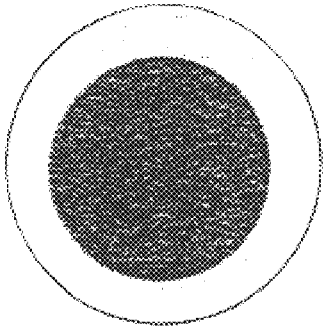
Figure 11A:
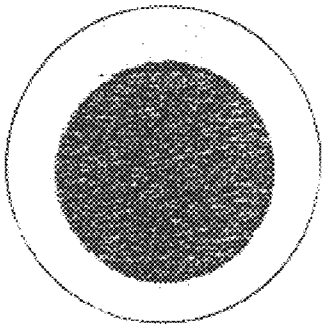
FIG. 11(*a*) is a filter face having collected sooty smoke in exhaust gases when combustion improving device of the FIG. 1 was mounted while a time period for the fuel to reside in the device was set at 1.5 seconds.
Figure 11B:
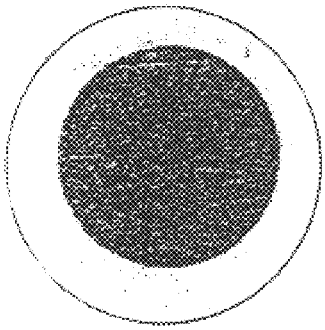
Figure 12A:
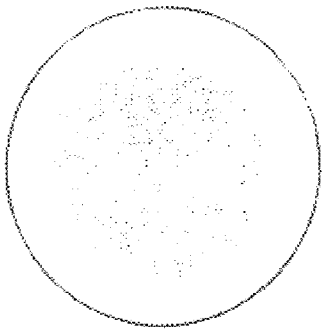
FIG. 12(*a*) is a filter face having collected the sooty smoke in exhaust gases when the combustion improving device of the embodiment was mounted while the time period the fuel to reside in the device was set at 2 seconds.
Figure 12B:
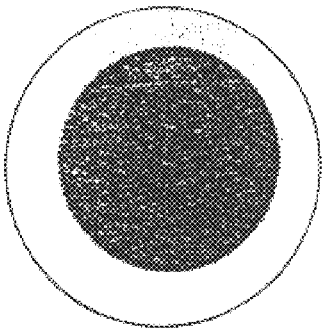

FIGS. 10 to 12 present filter faces having collected sooty smoke in cases in which a car of K-FE211C type (having an engine type of 4D30, a total displacement of 3,298 cc and an auxiliary combustion chamber) of Mitsubishi Motors was used and in which the residence times of the fuel between the confronting magnetic poles were 1 second, 1.5 seconds and 2 seconds, respectively. FIG. 10(*a*), FIG. 11(*a*) and FIG. 12(*a*) present the results when the combustion improving device of this embodiment was used, while FIG. 10(*b*), FIG. 11(*b*) and FIG. 12(*b*) present the results when the device was not used. As seen from the results of FIGS. 10 to 12: little effect is found for 1 second of the residence time, that is, the time during which the fuel is between the confronting magnetic poles; no prominent effect is found for 1.5 seconds; but an excellent effect is first found for about 2 seconds. It can be concluded that the necessary residence time is 1.5 seconds or more, preferably 1.7 seconds or more, or more preferably 1.9 seconds or more.

In the tests having obtained the results of FIGS. 10 to 12, the aforementioned residence times were set by changing the length of the inter magnetic pole fuel passage 3 in the combustion improving device 1 on the basis of the following calculations.

As shown in FIG. 2, the sectional area of the inter magnetic pole fuel passage 3 between the magnetic poles in the combustion improving device 1 of this embodiment can be deemed as 40 mm×0.7 mm=2.8 cm$^2$. The fuel feeding rate of the fuel pump 52 at a maximum speed of 3,000 rpm of the aforementioned engine is 30 cc/second. To set the residence time to 2 seconds, the length of the inter magnetic pole fuel passage 3 is set by following calculattion: 2 seconds×30 cm$^3$/second÷2.8 cm$^2$=about 22 cm.

Figure 13A:
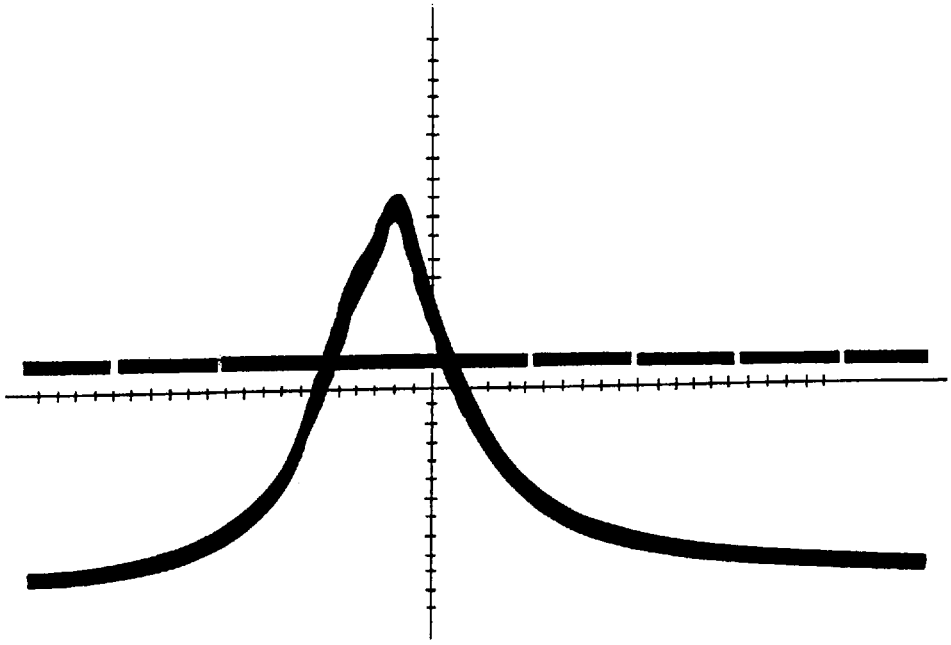
FIG. 13(*a*) is an indicator waveform (or combustion pressure waveform) diagram when the combustion improving device of FIG. 1 was mounted.
Figure 13B:
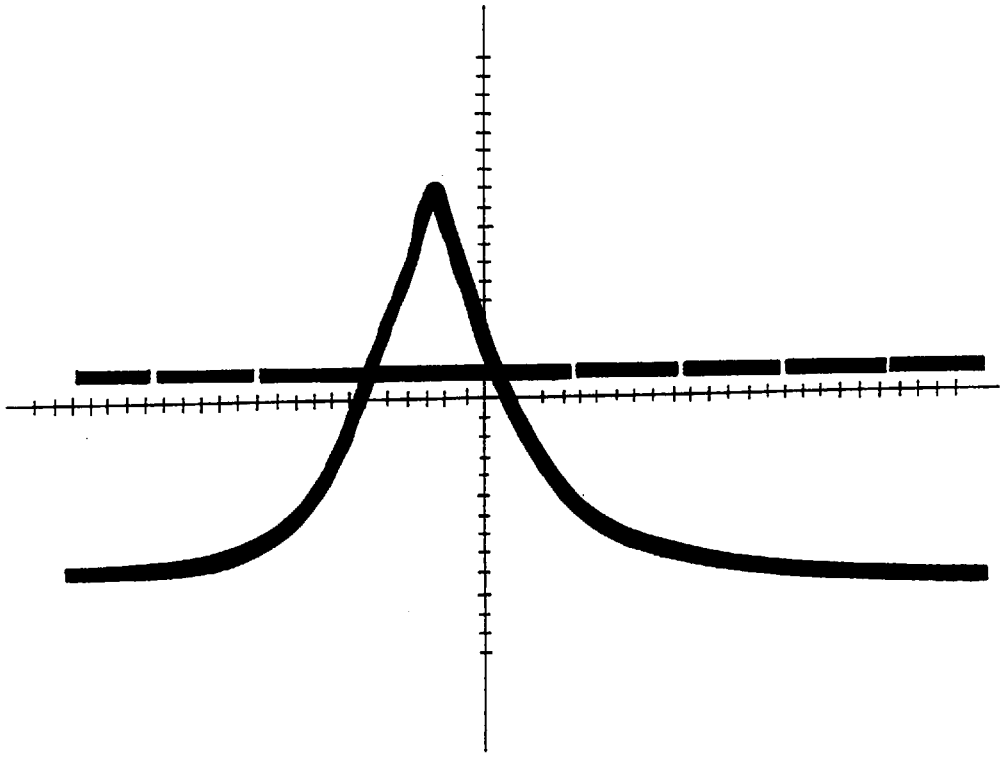

FIG. 13(*a*) and FIG. 13(*b*) are indicator waveform (or combustion pressure waveform) diagrams for a load factor of 30% on the embodiment, in which the aforementioned combustion improving device 1 was used, and on the comparison in which the device was not used.

The engine used in the tests was a D65 water-cooled transverse Diesel engine (having an engine No. 8822 and a total displacement of 353 cc) and had a cruising power of 4.04 KW (or 5.5 PS) at 2,400 rpm, a bore×stroke of 76×78 and a compression ratio of 25.

The dynamometer used in the tests was an air-cooled over-current braking type having an arm length of 0.2389 m and a dynamometer coefficient of 40 N·rpm/PS.

Since the indicator waveform (or combustion pressure waveform) of FIG. 13(*a*) has a somewhat gentler peak than that of FIG. 13(*b*), it is found that the combustion state is more satisfactory in the case where the combustion improving device 1 of the embodiment is used.

The indicator waveform diagrams of FIG. 13 will be further described with reference to a schematic indicator waveform diagram of FIG. 14. Here, the embodiment (of FIG. 13(*a*)) is plotted by a solid line, and the comparison (of FIG. 13(*b*)) is plotted by a broken line. It is seen that the indicator waveform of the embodiment has an ignition delay period A to B is made shorter than that of A to B' of the comparisons and that an abrupt pressure rise after the ignition is suppressed.

The combustion of the Diesel engine is evaluated to have the higher thermal efficiency when the ignition delay period is shorter. It is also known that if the pressure rise after an ignition is moderated the production of nitrogen oxides, as might otherwise be caused by the Diesel knock or by a combustion at an excessively high temperature, is suppressed.

Therefore, the combustion improving device of the invention is effective not only for the aforementioned exhaust gas improvement but also for the improvement in the combustion efficiency or for reducing noise by suppressing Diesel knock.

Figure 14:
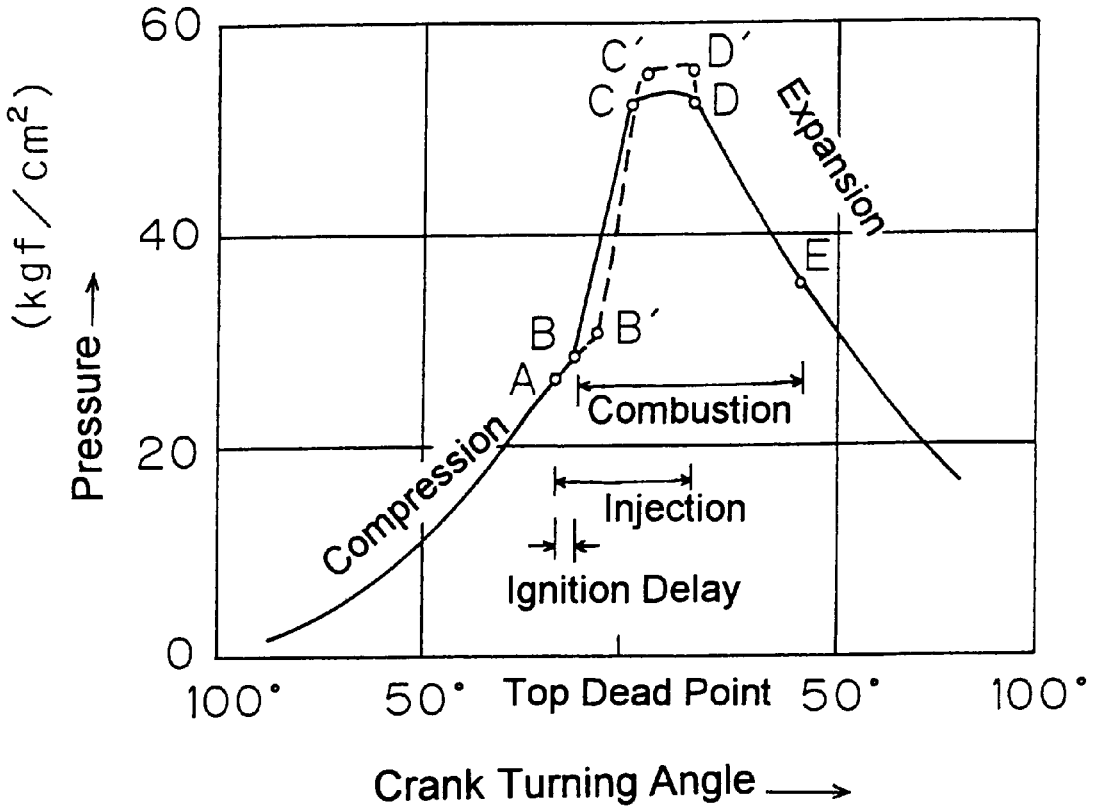
FIG. 14 is a schematic indicator waveform for explaining FIG. 13.

It is not clear in which mechanism the device of the invention causes the improvement of the combustion shown in FIGS. 13 and 14. It is, however, presumed that the fuel injected into the combustion chamber is more atomized or gasified either by activating it by the action of the magnetism on it or by the radio frequency caused by the resonance vibration of the magnets arranged to confront each other.

The combustions of the gasoline engine and the Diesel are thus improved to reduce noxious emissions such as smoke or nitrogen oxides.

In the Diesel engine, the combustion efficiency is improved while reducing the Diesel knock to suppress the noise.

What is claimed is:

1. A combustion improving device for an engine for disposal in a fuel feeding path to the engine wherein fuel is fed at a rate up to a predetermined rate, comprising:

a housing having at least two magnets with confronting magnetic poles arranged to confront each other, said housing and said at least two magnets defining a fuel passage between said confronting magnetic poles of said at least two magnets;

said at least two magnets having a sufficient magnetic field strength to generate a magnetic force per unit area acting between said confronting magnetic poles being equal to or greater than 0.15 kgf/cm$^2$;

said at least two magnets being disposed a distance apart such that said confronting magnetic poles are disposed relative one another within a range in which the magnetic force per unit area between said confronting magnetic poles increases substantially in proportion to a decrease in said distance; and said housing and said at least two magnets being dimensioned such that a time period for the fuel to pass between said confronting magnetic poles at said predetermined rate is equal to or greater than 1.7 seconds.

2. The combustion improving device as set forth in one of claim 1 or 2, wherein:

said housing and said at least two magnets define a substantially horizontally disposed fuel passage having a top surface wherein the fuel flows substantially horizontally; and said housing has a wall extending parallel to said top surface and defining a fuel outlet port arranged at an uppermost part of said fuel passage and opening upwardly such that air in said fuel passage exits in an upward direction.

3. The combustion improving device of claim 1 wherein said predetermined rate is a fuel flow rate at a maximum RPM of the engine.

4. The combustion improving device of claim 1 wherein said confronting magnetic poles are of like polarity.

5. A combustion improving device as set forth in claim 2, further comprising:

said at least two magnets including first and second opposing sets of magnets extending along at least a portion of the fuel passage;

first and second baffle-acting spacer sheets each being disposed between two adjacent ones of each of said first and second opposing sets of magnets; and said first and second baffle-acting spacer sheets respectively defining first and second fuel-passing apertures, said apertures being disposed offset from one another in a widthwise direction of said fuel passage.

6. The combustion improving device as set forth in claim 2, further comprising first and second fixation fittings disposed in said housing respectively proximate an inlet portion and an outlet portion of said fuel passage to clamp between the first and second fixation fitting said at least two magnets.

7. The combustion improving device as set forth in claim 6, wherein each of said first and second fixation fittings are formed by bending of a metal plate.

8. The combustion improving device of claim 1 wherein said time period for the fuel to pass between said confronting magnetic poles at said predetermined rate is equal to or greater than 1.9 seconds.

9. A combustion improving device for an engine for disposal in a fuel feeding path to the engine wherein fuel is fed at a rate up to a predetermined rate, comprising:

a housing having at least two magnets with confronting magnetic poles arranged to confront each other, said housing and said at least two magnets defining a fuel passage between said confronting magnetic poles of said at least two magnets;

said at least two magnets having a sufficient magnetic field strength to result in a quantity calculated by dividing a magnetic force per unit area between said confronting magnetic poles by a distance between said confronting magnetic poles being equal to or greater than 0.20 kgf/cm$^3$;

said at least two magnets being disposed a distance apart such that said confronting magnetic poles are disposed relative one another within a range in which the magnetic force per unit area between said confronting magnetic poles increases substantially in proportion to a decrease in said distance; and said housing and said at least two magnets being dimensioned such that a time period for the fuel to pass between said confronting magnetic poles at said predetermined rate is equal to or greater than 1.7 seconds.

10. The combustion improving device of claim 9 wherein said predetermined rate is a fuel flow rate at a maximum RPM of the engine.

11. The combustion improving device of claim 9 wherein said confronting magnetic poles are of like polarity.

12. The combustion improving device of claim 9 wherein said time period for the fuel to pass between said confronting magnetic poles at said predetermined rate is equal to or greater than 1.9 seconds.

13. A combustion improving device for an engine for disposal in a fuel feeding path to the engine wherein fuel is fed at a rate up to a predetermined rate, comprising:

a housing having at least two magnets with confronting magnetic poles arranged to confront each other, said housing and said at least two magnets defining a fuel passage between said confronting magnetic poles of said at least two magnets;

said at least two magnets having a sufficient magnetic field strength and sufficient dimensions to result in that product of a magnetic force per unit area between said confronting magnetic poles and a time period for the fuel to pass through between said confronting magnetic poles is equal to or greater than a product of (0.15 $kgf/cm^2$)×(1.7 seconds); and said at least two magnets being disposed a distance apart such that said confronting magnetic poles are disposed relative one another within a range in which the magnetic force per unit area between said confronting magnetic poles increases substantially in proportion to a decrease in said distance.

14. The combustion improving device of claim 13 wherein said predetermined rate is a fuel flow rate at a maximum RPM of the engine.

15. The combustion improving device of claim 13 wherein said confronting magnetic poles are of like polarity.

16. A combustion improving method for an engine, comprising the steps of:

feeding a fuel a fuel tank to the engine at a rate up to a predetermined rate through a gap between confronting magnetic poles;

providing said confronting magnetic poles with a sufficient magnetic field strength to generate a magnetic force per unit area acting between said confronting magnetic poles which is equal to or greater than 0.15 $kgf/cm^2$; and providing said confronting magnetic poles with dimensions such that a time period for the fuel to pass between said confronting magnetic poles at said predetermined rate is equal to or greater than 1.7 seconds.

17. The method of claim 16 wherein said predetermined rate is a fuel flow rate at a maximum RPM of the engine.

18. The method of claim 16 wherein said confronting magnetic poles are of like polarity.

19. The combustion improving device of claim 16 wherein said time period for the fuel to pass between said confronting magnetic poles at said predetermined rate is equal to or greater than 1.9 seconds.

20. A method for producing a combustion improving device, wherein the combustion improving device is for an engine and is to be disposed in a fuel feeding path to the engine feeding fuel at rates up to a predetermined rate, and the combustion improving device has a fuel passage between confronting magnetic poles, comprising the steps of:

providing said confronting magnetic poles with a magnetic field strength such that a magnetic force per unit area acting between said confronting magnetic poles is equal to or greater than 0.15 $kgf/cm^2$;

providing said confronting magnetic poles with a distance between said confronting magnetic poles within such a range that magnetic force between said confronting magnetic poles increases substantially in proportion to decrease in said distance; and providing said confronting magnetic poles in dimensions such that a time period for the fuel to pass between said confronting magnetic poles is 1.7 seconds or more when the fuel is fed at said predetermined rate.

21. The method of claim 20 wherein said predetermined rate is a fuel flow rate at a maximum RPM of the engine.

22. The method of claim 20 wherein said confronting magnetic poles are of like polarity.

23. The combustion improving device of claim 20 wherein said time period for the fuel to pass between said confronting magnetic poles at said predetermined rate is equal to or greater than 1.9 seconds.

24. A method for producing a combustion improving device, wherein the combustion improving device is for an engine and is to be disposed in a fuel feeding path to the engine feeding fuel at rates up to a predetermined rate, and the combustion improving device has a fuel passage between confronting magnetic poles, comprising the steps of:

providing said confronting magnetic poles with a magnetic field strength and a distance therebetween such that a value calculated by dividing a magnetic force per unit area between said confronting magnetic poles by said distance between said confronting magnetic poles is equal to or greater than 0.20 $kgf/cm^3$;

providing said confronting magnetic poles with said magnetic field strength such that said magnetic force per unit area acting between said confronting magnetic poles is equal to or greater than 0.15 $kgf/cm^2$;

providing said confronting magnetic poles with said distance between said confronting magnetic poles within such a range that magnetic force between said confronting magnetic poles increases substantially in proportion to decrease in said distance; and providing said confronting magnetic poles in dimensions such that a time period for the fuel to pass between said confronting magnetic poles is 1.7 seconds or more when the fuel is fed at said predetermined rate.

25. The method of claim 24 wherein said predetermined rate is a fuel flow rate at a maximum RPM of the engine.

26. The method of claim 24 wherein said confronting magnetic poles are of like polarity.

27. The combustion improving device of the claim 24 wherein said time period for the fuel to pass between said magnetic poles at said predetermined rate is equal to or greater than 1.9 seconds.

* * * * *